US007073516B1

(12) United States Patent
Beamen

(10) Patent No.: US 7,073,516 B1
(45) Date of Patent: Jul. 11, 2006

(54) BRAID REMOVAL DEVICE

(76) Inventor: Lawrence McGowan Beamen, 1420 S. Main St., Walnut Creek, CA (US) 94596

( * ) Notice: Subject to any disclaimer, the term of this patent is extended or adjusted under 35 U.S.C. 154(b) by 379 days.

(21) Appl. No.: 10/632,766

(22) Filed: Aug. 1, 2003

(51) Int. Cl.
*A45D 24/00* (2006.01)

(52) U.S. Cl. ..... 132/200

(58) Field of Classification Search ..... 132/212, 132/200, 201, 213–214; 2/21; 30/140, 90.1; 219/223, 225; 606/120
See application file for complete search history.

(56) References Cited

U.S. PATENT DOCUMENTS 5,012,830 A * 5/1991 Vaccaro et al. ..... 132/213.1
5,472,654 A * 12/1995 Crawford ..... 264/163
5,769,100 A * 6/1998 Alexander ..... 132/271
5,783,800 A * 7/1998 Thompson et al. ..... 219/225
6,135,124 A * 10/2000 Grant ..... 132/271
6,708,699 B1 * 3/2004 McGriff, III ..... 132/269

* cited by examiner

*Primary Examiner*—John J. Wilson
*Assistant Examiner*—Robyn Doan
(74) *Attorney, Agent, or Firm*—Risto A. Rinne, Jr.

(57) ABSTRACT

An apparatus for the cutting and removal of a braid from a person's natural hair includes a first member and a second member that are adapted to pivot about an axis under control by a hand of a user. The first member includes a linear longitudinal edge that cannot cut hair and is adapted to contact an inner edge of the second member. The inner edge includes a comb portion that is preferably detachable and an arcuate recess that provides an opening to receive the natural hair therein, a protrusion that functions as a pick to loosen the natural hair from the braid, and a cutting portion that is adapted to cut the braid where desired. Accordingly, all cutting, loosening, braid removal and combing operations are performed using the one apparatus, thereby expediting braid removal.

3 Claims, 1 Drawing Sheet

BRAID REMOVAL DEVICE

BACKGROUND OF THE INVENTION

1. Field of the Invention

The present invention, in general relates to beauty products and, more particularly, to a device for removing braids and tangles from the hair.

In particular, African-Americans genetically have hair that resists the formation of longer lengths. Still, these longer length styles can enhance the appearance. Accordingly, it is common for African-American people to attach braids to their own natural hair.

These braids are formed of either natural hair (from any source) or they are formed of a synthetic material and are attached to the African-American's hair by weaving a length of the person's natural hair into an end of the braid, which is then suspended from the natural hair. Several strands of natural hair are used to secure each braid.

When this is repeated, a natural looking attractive array of braids provide the illusion of long hair. The braids can include beads or other ornamentation as may be desired or they can be unadorned.

Installation can take from four to six hours and cost from $75.00 to over $150.00, depending upon the density of installation. These braids typically last from one to two months and must then be removed. Removal takes approximately three hours to accomplish and can cost upwards of $100.00. Removal is labor intensive in that the braid is cut just below where the natural hair ceases. The natural hair must then be untangled from the braid.

No tools exist to facilitate this process. Beauticians will break off the teeth from a comb and use the end as a pick to separate the natural hair apart from the braid. The beautician is constantly setting down the comb (i.e., pick) for scissors and back to the comb again.

The process of removing each braid begins by cutting the braid at the end of the strands of natural hair that support it. Then the braid must be removed from the natural hair. As mentioned above, the only known tool for this purpose is a pick. It is time consuming, and therefore expensive, to have to pick at the natural hair to pull it away from the braid. Yet, there are times when this is required to initially loosen the natural hair from the braid. Then the braid must be pulled off of the hair. Finally, the natural hair is combed to further straighten it.

Furthermore, the density of natural hair is a variable as well. Once the braid has been removed, it is necessary to comb the hair straight, yet this process is affected by the density and curl of the person's natural hair. Accordingly, for some people a coarse comb with only a few teeth are preferred for this process whereas for others, a denser comb with more teeth are preferred. If too many teeth are present in the comb, it is difficult to pass through the hair. If too few teeth are present, additional passes will be required, thereby lengthening the time required to remove the braids.

Accordingly, there exists today a need for a braid removal device that can help ameliorate the aforementioned problems.

Clearly, such an apparatus would be a useful and desirable device.

2. Description of Prior Art

Combs, brushes, and scissors are, in general, known. While the structural arrangements of the above described devices, at first appearance, may have certain similarities with the present invention, they differ in material respects. These differences, which will be described in more detail hereinafter, are essential for the effective use of the invention and which admit of the advantages that are not available with any of the prior devices.

OBJECTS AND SUMMARY OF THE INVENTION

It is an object of the present invention to provide a braid removal device that can facilitate the removal of a braid that is attached to the hair.

It is also an important object of the invention to provide a braid removal device that includes a plurality of tools attached thereto that are useful in removing a braid.

Another object of the invention is to provide a braid removal device that includes a curved portion that can be urged so as to rest on a linear edge and which is useful in pulling a braid away from natural hair.

Still another object of the invention is to provide a braid removal device that includes a cutting device.

Still yet another object of the invention is to provide a braid removal device that includes a comb that can be urged so as to rest on a linear edge and which is useful in straightening out a section of natural hair after removal of a braid.

Yet another important object of the invention is to provide a braid removal device that includes a pick.

Still yet another important object of the invention is to provide a braid removal device that includes a comb.

Still yet one further important object of the invention is to provide a braid removal device that includes a comb that has a section of teeth having a particular pattern and density of teeth that can be replaces by at least one alternative pattern and density of teeth.

Still one additional important object of the invention is to provide a braid removal device that is adapted to decrease the time required to remove a braid from a person's hair.

Briefly, a braid removal device that is constructed in accordance with the principles of the present invention has a cutting device attached thereto. An arcuate portion is included along a linear edge that provides an opening. When the arcuate portion abuts the linear edge an enclosed semi-circle if formed. A pick is attached to the device where desired. A comb is also included in the device and preferably includes a plurality of replacement teeth. The comb, preferably, also can be urged into contact with the linear edge. In use, the cutting device is used to sever the braid at the end of the natural hair. The pick is used, as needed, to loosen and partially separate the natural hair from the remaining segment of the braid. The enclosed semi-circle is used to urge the loosened remaining segment of the braid from the natural hair. The comb is used to straighten the natural hair that was previously woven into the braid.

DETAILED DESCRIPTION OF THE INVENTION

Figure 1:
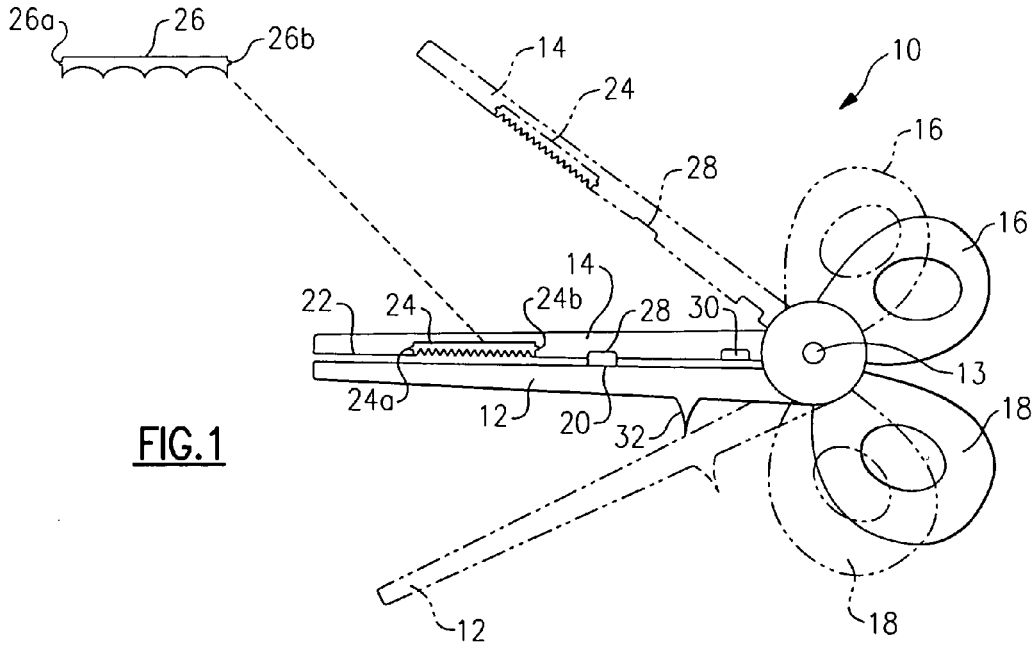
FIG. 1 is a plan view of a braid removal device.

Referring to FIG. 1 is shown, a braid removal device, identified in general by the reference numeral 10. The braid removal device 10 resembles a conventional pair of scissors (not shown) in appearance primarily, in that a first member 12 is adapted to pivot about an axis 13 with respect to a second member 14.

A first finger receptive member 16 is attached to the first member 12 and a second finger receptive member 18 is attached to the second member 14, as is common with conventional types of scissors.

The first member 12 includes a linear edge 20. Unlike conventional scissors, the linear edge 20 is blunt and not intended to cut hair. The linear edge 20 is adapted to contact and abut against an inner edge 22 of the second member when the first finger receptive member 16 and the second finger receptive member 18 are urged toward each other, as shown. The inner edge 22 is generally blunt as well so as not to cut hair, except as is described in greater detail hereinafter.

A first comb insert 24 snaps into a recess provided in the second member 14. The first comb insert 24 includes a plurality of teeth that are spaced close to each other. A second comb insert 26 is disposed away from the braid removal device 10 and is connected thereto by a dashed line.

The first comb insert 24 includes a pair of extensions 24*a*, 24*b* that fit into a pair of corresponding notches that are provided in the recess. The first comb insert 24 is removed by sliding it out of the recess (i.e., either into or out of the paper). It, or the second comb insert 26 are inserted by sliding either one (and its pair of extensions 26*a*, 26*b*) into the recess, again in or out of the paper.

If the person's hair is fine or easy to comb, then the first comb insert 24 (with a greater density of teeth) is used. If the person's hair is instead especially coarse or difficult to comb, then the second comb insert 26 is used. Accordingly, at the beginning of the process of removing braids, the desired comb insert 24, 26 is installed in the braid removal device 10 and used for the process. It is of course possible to later change the insert 24, 26 from one to the other as desired. Other inserts (not shown), each having a different profile of teeth or a different density of teeth can be used, as desired.

An arcuate recess 28 that resembles a semi-circle is provided in the second member 14. This is used to pull a severed braid from natural hair, as described in greater detail hereinafter.

A cutting device 30 is also included and is useful for cutting the braids. The preferred cutting device 30 includes an especially sharp knife edge, such as provided by a segment of a razor.

A pointed protrusion 32 acts as a pick and is useful for loosening natural hair from a severed braid. Accordingly, the braid removing device 10 includes all elements for braid removal in a convenient tool.

In use, a braid is cut at a location that is below where a person's natural hair ends using the cutting device 30. The natural hair was previously woven into the braid so as to secure it (the braid) in position. This is well known in the art of adding braids to people's hair. It is especially common among African-Americans, but can of course be used with people of any race or ethnic background.

After having been cut, a segment of the braid remains attached (i.e., woven) into the person's natural hair. To loosen the natural hair, the pick 32 (i.e., the pointed protrusion) is used to prod and pull the natural hair from the remaining segment of the braid.

Once the natural hair has been sufficiently loosened, the first finger receptive member 16 and the second finger receptive member 18 are first urged away from each other so as to open the first and second members 12, 14 with respect to each other (as shown in dashed lines). The remaining segment of the braid and cluster of woven natural hair are inserted between the first finger receptive member 16 and the second finger receptive member 18 proximate the arcuate recess 28. The first finger receptive member 16 and the second finger receptive member 18 are then urged toward each other until the first and second members 12, 14 contact each other with the remaining segment of the braid disposed in the arcuate recess 28 and on one side of it. The braid removal device 10 is then urged sideways toward the remaining segment of the braid (i.e., either in or out of the paper) to urge the remaining segment away from the natural hair. The remaining segment then falls to the floor.

The first and second members 12, 14 are then opened, as was previously described, and the braid removing device 10 is moved so as to cause the natural hair to align with the teeth of the comb insert 24. The first and second members 12, 14 are closed and the braid removal device 10 is again moved sideways so as to comb the natural hair, thereby removing any tangles that may remain. This process can be repeated a few times, as needed.

Accordingly, the braid removal device 10 provides in one device all components necessary to remove an add-on braid from a person's hair. This greatly speeds the process thereby decreasing cost.

Figure 2:
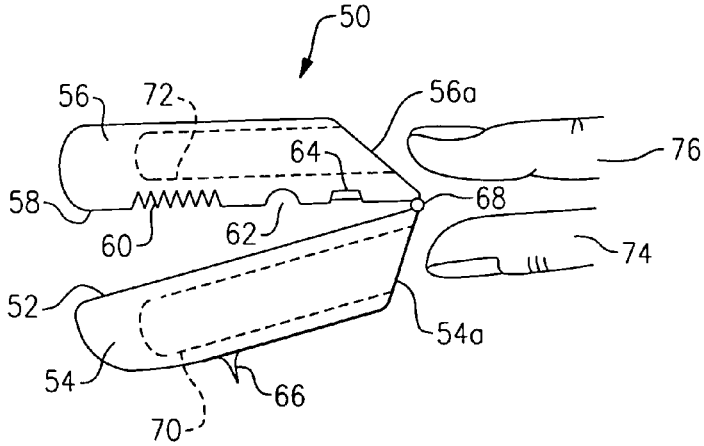
FIG. 2 is a plan view of a modified braid removal device.

Referring now to FIG. 2, is shown, a modified braid removal device identified in general by the reference numeral 50.

The modified braid removal device 50 includes in slightly modified forms the essential elements of the braid removal device 10 of FIG. 1.

A modified linear edge 52 that cannot cut hair is provided on a first modified member 54. A second modified member 56 includes a modified inner edge 58 that also cannot cut hair except at a modified cutting portion 64.

A modified comb segment 60 is included in the modified inner edge 58 as is a modified arcuate portion 62 and the modified cutting portion 64.

A modified pointed protrusion 66 that functions as a pick is provided on an exterior portion of the modified first member 54, although its position can be moved, as desired.

The modified braid removal device 50 is preferably made of a molded plastic and includes a flexible integral molded plastic hinge 68 that provides a modified axis about which the first modified member 54 can pivot in an arc with respect to the second modified member 56.

Each of the first and second modified members 54, 56 increase in size from the modified linear edge 52 and the modified inner edge 58 to provide a cylindrical body that is open on a first end of each modified member 54*a*, 56*a* respectively.

The open first end of each modified member 54*a*, 56*a* provides access to a modified first finger receptive member 70 (shown in dashed lines) that includes a recess that is provided inside of the modified first member 54 and a modified second finger receptive member 72 (shown in dashed lines) that includes a second recess that is provided inside of the modified second member 56.

A thumb 74 and index finger 76 are inserted into the modified first finger receptive member 70 recess and into the modified second finger receptive member 72 recess through each open end 54*a*, 56*a*, respectively.

By opening and closing the thumb 74 and index finger 76 with respect to each other as desired, the modified braid removal device 50 is used in like-fashion to that as was previously described for the braid removal device 10.

Accordingly, the modified braid removal device 50 provides a compact and inexpensive version having all of the features previously described and which can thereby also facilitate rapid braid removal and detangling of the person's natural hair.

It is important to note that the braid removal device 10 and modified braid removal device 50 provide a previously unknown and unexpected benefit regarding the comb portions thereof 24, 26, 60 in that when the linear edge 20 or modified linear edge 52 is in contact with the inner edge 22 or modified inner edge 58 and the natural hair is disposed along the first and second comb inserts 24, 26 or along the modified comb segment 60 it is forced to engage the teeth thereof. This ensures that the natural hair will be affected by the teeth when either the device 10 or modified device 50 is displaced along the longitudinal length of the natural hair. This positive engagement greatly increases the efficacy of the combing action which further lessens the time required to straighten the natural hair.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A method for removing a braid from a plurality of natural hairs that are woven into a portion of said braid utilizing a single device, comprised of the steps of:

(a) providing a braid removing device that includes a first member having a linear edge along a side thereof, a second member having an inner edge, said second member being adapted to pivot about an axis with respect to said first member wherein said inner edge is adapted to contact at least a portion of said linear edge and wherein said linear edge and said inner edge are not adapted to cut hair when in contact with each other, and wherein said inner edge includes an opening when said linear edge and said inner edge are in contact with each other that is adapted to enclose said plurality of natural hairs, and wherein said opening is adapted to facilitate the removal of said braid when said opening is urged in a direction toward said braid sufficient to make contact with at least a portion of said braid and including a cutting portion attached to said device;

(b) contacting said cutting portion with said braid along a longitudinal length of said braid at a location that does not contain any of said plurality of natural hairs sufficient to sever said braid;

(c) inserting at least a portion of said plurality of natural hairs intermediate said first member and said second member in said opening;

(d) urging said first member toward said second member;

(e) displacing said device along a longitudinal length of said portion of said plurality of natural hairs toward a remaining portion of said braid until contacting said remaining portion of said braid; and (f) further displacing said device along said longitudinal length of said portion of said plurality of natural hairs an amount sufficient to dislodge said remaining portion of said braid from said portion of said natural hairs.

2. The method of claim 1 including a first additional step of including a pick with said device and a second additional step of using said pick to loosen said natural hairs from said braid prior to the step of further displacing said device along said longitudinal length of said portion of said plurality of natural hairs an amount sufficient to dislodge said remaining portion of said braid from said portion of said natural hairs.

3. The method of claim 1 including the further step of providing a comb section with said device and the still further step of passing said comb section through said portion of said natural hairs after the step of further displacing said device along said longitudinal length of said portion of said plurality of natural hairs an amount sufficient to dislodge said remaining portion of said braid from said portion of said natural hairs.

* * * * *